United States Patent [19]

Scheiwiller

[11] Patent Number: 4,627,764

[45] Date of Patent: Dec. 9, 1986

[54] PAVING STONE, PROCESS FOR MANUFACTURING SAME AND DEVICE FOR CARRYING OUT THE MANUFACTURING PROCESS

[76] Inventor: Rolf Scheiwiller, Beichelacker, 3115 Gerzensee, Switzerland

[21] Appl. No.: 692,329

[22] Filed: Jan. 17, 1985

Related U.S. Application Data

[63] Continuation of Ser. No. 358,036, Mar. 15, 1982, abandoned.

[30] Foreign Application Priority Data

Mar. 25, 1981 [EP] European Pat. Off. ..... 81810120

[51] Int. Cl.[4] ..... E01C 5/00

[52] U.S. Cl. ..... 404/41; 404/39; 404/42; 52/314; 52/605

[58] Field of Search ..... 404/34, 37–39, 404/41, 42, ; 52/98, 100, 314, 605

[56] References Cited

U.S. PATENT DOCUMENTS

| | | | |
|---|---|---|---|
| 572,762 | 12/1896 | Landers | 404/39 X |
| 829,480 | 8/1906 | Mills | 404/41 |
| 2,108,226 | 2/1938 | Johnston | 404/42 |
| 3,242,832 | 3/1966 | Schnaar | 404/39 |
| 3,870,423 | 3/1975 | Peitz, Jr. | 404/41 |
| 3,873,225 | 3/1975 | Jakobsen et al. | 404/41 |
| 3,891,340 | 6/1975 | Bolli | 404/38 |
| 3,922,105 | 11/1975 | Bolli | 404/34 |
| 3,940,229 | 2/1976 | Hutton | 425/436 R |
| 4,185,939 | 1/1980 | Barth et al. | 404/38 |
| 4,326,817 | 4/1982 | Boiardi | 404/39 X |

FOREIGN PATENT DOCUMENTS

| | | | |
|---|---|---|---|
| 526573 | 3/1954 | Belgium | 404/34 |
| 6942620 | 10/1969 | Fed. Rep. of Germany . | |
| 1658513 | 9/1970 | Fed. Rep. of Germany . | |
| 1912155 | 11/1970 | Fed. Rep. of Germany | 404/41 |
| 1584523 | 3/1973 | Fed. Rep. of Germany . | |
| 7402188 | 4/1974 | Fed. Rep. of Germany . | |
| 2357854 | 7/1974 | Fed. Rep. of Germany . | |
| 2526631 | 12/1976 | Fed. Rep. of Germany . | |
| 2533787 | 2/1977 | Fed. Rep. of Germany . | |
| 1577208 | 4/1977 | Fed. Rep. of Germany . | |
| 2548997 | 5/1977 | Fed. Rep. of Germany . | |
| 2604336 | 3/1978 | Fed. Rep. of Germany . | |
| 7829810 | 1/1979 | Fed. Rep. of Germany . | |
| 7801963 | 11/1979 | Fed. Rep. of Germany . | |
| 2826661 | 12/1979 | Fed. Rep. of Germany . | |
| 8028909 | 12/1980 | Fed. Rep. of Germany . | |
| 943877 | 3/1949 | France . | |
| 1556984 | 2/1969 | France . | |
| 2439852 | 5/1980 | France . | |
| 433891 | 4/1948 | Italy | 404/41 |
| 24909 | of 1896 | United Kingdom | 404/41 |
| 1211099 | 11/1970 | United Kingdom | 404/41 |

*Primary Examiner*—Stephen J. Novosad
*Assistant Examiner*—John F. Letchford
*Attorney, Agent, or Firm*—Wender Murase & White

[57] ABSTRACT

The paving stone comprises a recess which divides the stone into an upper part having a smaller circumference and a lower part with a greater circumference. The lower part, having also a greater height than the upper part, comprises a ribbing or other vertically oriented interlocking means and the upper part can have the appearance of a natural stone. The shape of either the upper or the lower part may be chosen arbitrarily and independent from each other. The molding box for the manufacturing of such paving stones is made of two pieces joined together and comprises the corresponding recess. The lower piece comprises an insert for forming interlocking means.

11 Claims, 10 Drawing Figures

PAVING STONE, PROCESS FOR MANUFACTURING SAME AND DEVICE FOR CARRYING OUT THE MANUFACTURING PROCESS

This application is a continuation, of application Ser. No. 358,036, filed Mar. 15, 1982, now abandoned.

BACKGROUND OF THE INVENTION

The present invention relates to a paving stone, a process for manufacturing same and a device for carrying out the manufacturing process.

A plurality of paving stones are known which generally fall into two categories man-made paving stones and paving natural stones. While natural stones are aesthetically pleasing, they are not uniform in size and in shape, which makes laying a pavement difficult. When laying man-made paving stones, it is often difficult to obtain a regularly formed joint. It is often advantageous if the interlocking of the stones between themselves is made very strong. It is also advantageous if the designer of a man-made stone has as much as freedom as possible with regard to the shape of the stone visible after laying thereof but that, nonetheless enables easy laying and a good interlocking.

It is an object of the present invention to create paving stone, a process for manufacturing same and a device for carrying out the manufacturing process which do not present the above-mentioned disadvantages, provide a regular width of the joint and a good interlocking of the stones between themselves and offer more freedom in the design of the visible part of the stones.

SUMMARY OF THE INVENTION

The paving stone according to the present invention has a recess, dividing the height of the stone in a lower and an upper part, the lower part with a greater circumference, having a greater height than the upper part , which has a smaller circumference and vertically oriented interlocking means on the lower part.

In the manufacturing process, the material is fed into a two-part molding box, compressed and pressed out by means of a plunger.

The device for carrying out the manufacturing process comprises a molding box having two parts welded, screwed or glued together, wherein the parts form a recess, the upper part of the molding box having openings with smaller dimensions than the ones of the lower part with greater height the lower part also has an insert for forming interlocking means.

The invention will described further by way of example with reference to the accompanying drawings.

DESCRIPTION OF THE PREFERRED EMBODIMENTS

Figure 1:
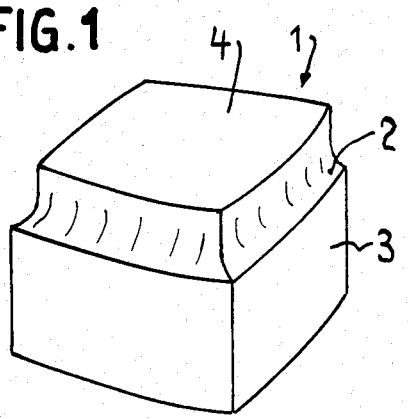
FIG. 1 shows a first embodiment of a paving stone.
Figure 2:
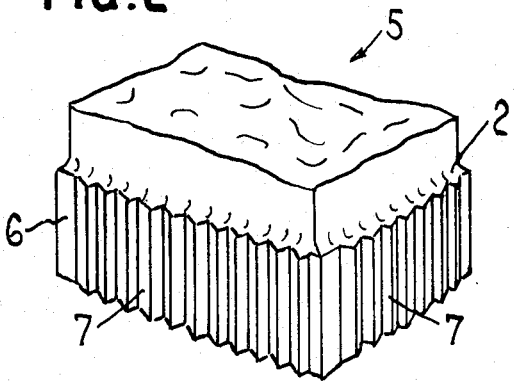
FIG. 2 shows another paving stone.
Figure 3:
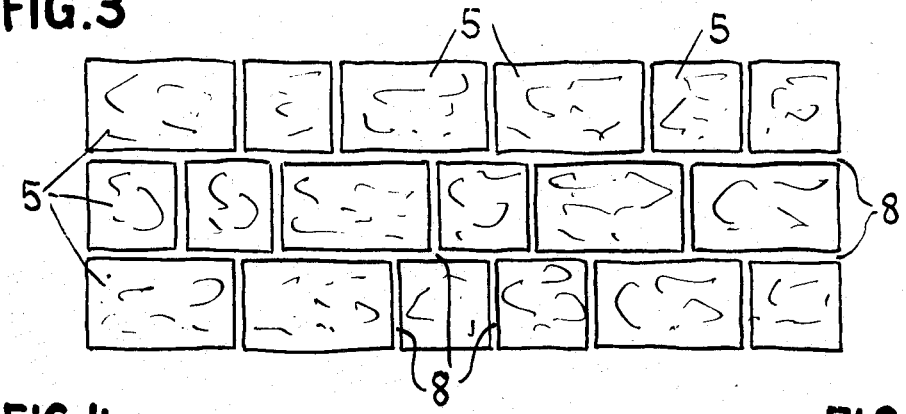
FIG. 3 shows laid paving stones constructed according to FIG. 2.
Figure 4:
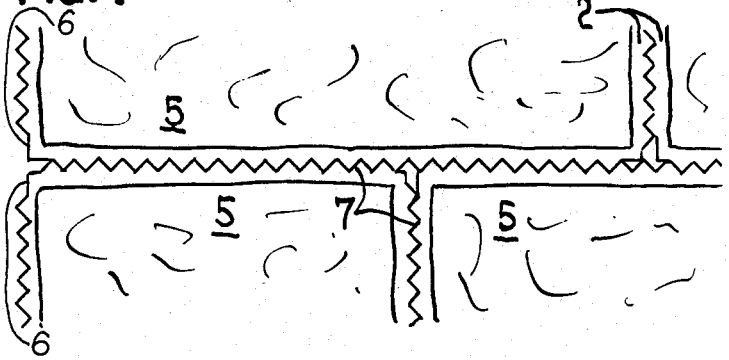
FIG. 4 shows an enlarged part of FIG. 3.
Figure 5:
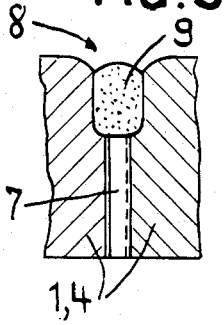
FIG. 5 shows a section of two laid stones.
Figure 6:
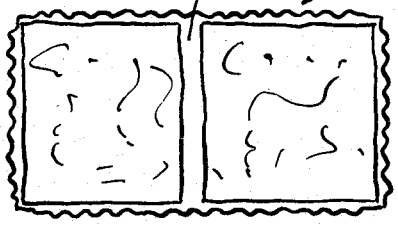
FIG. 6 shows a further paving stone.
Figure 7:
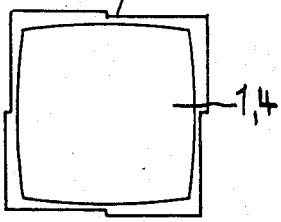
FIG. 7 shows a further embodiment of a paving stone.

FIG. 1 shows a first embodiment of a paving stone 1 defining a recess 2 dividing the stone into a part 3 with a greater circumference and a part 4 with a smaller circumference, the height of the part 3 being greater than the height of part 4. In the present example, both parts 3 and 4 comprise a peripheral surface arched in the middle toward the outside. In the laid condition the recess 2 produces a joint between two adjacent stones. FIG. 2 shows a paving stone 5 the upper surface of which having the appearance of a natural stone. As indicated in FIG. 3, the stones 5 provide also regularly formed joints 8 as desired for pavements formed of natural stones. The lower offset part 6 comprises in this case a ribbing 7 which provide a good interlocking of the stones between themselves, as illustrated in FIG. 4. The utilization of such paving stones of a configuration having upper portions with an appearance similar to one of natural stones simplifies the laying thereof because there exists on the one hand a very good hold between the individual stones and on the other hand the stones, in particular its lower parts, not be dressed because they have great regularity. FIG. 5 shows how the joints 8 between individual stones may be filled either with sand or bitumen 9. FIG. 6 shows a further practical example of a paving stone 10 comprising a notch 11 in its center having the same width as the joint 8, this permitting the stone to be split into two parts by a mechanical action exerted on it. This produces the variety of long and short stones indicated in FIG. 3. FIG. 7 shows a further embodiment of a stone with an indentation 12 whereby many indentations may be provided on either side of the stone.

Figure 10:
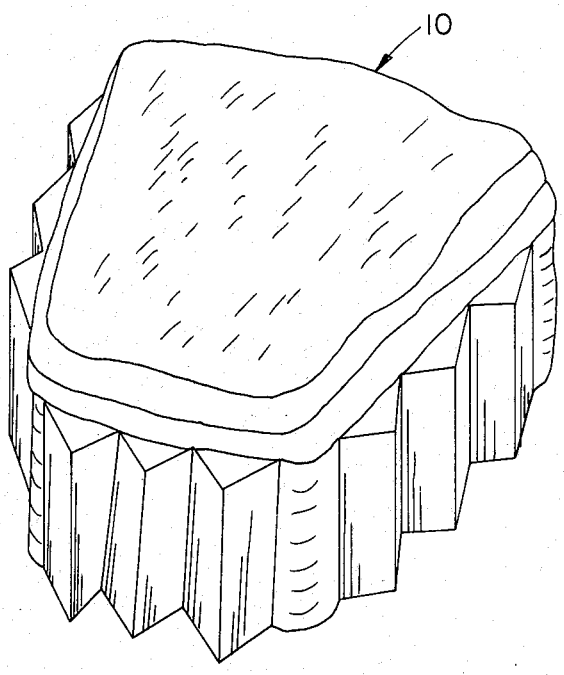
FIG. 10 shows another embodiment of a paving stone.

The stones illustrated in FIGS. 1, 2, 6 and 7 show only a small part out of a plurality of paving stones which may be manufactured according to the recognizable principle of a bipartition in the height of the individual stones. It is for example possible to provide the lower part of the stone of FIG. 1 with a ribbing like the one of the stone 5 or with an indentation like the one of the stone of FIG. 7 or further to provide the stone of FIG. 2 with a ribbed lower part or with indentations like the one of FIG. 7. It is further clear that the stone may have any other shape, e.g. the configuration of a sector, such as the stone 10 in FIG. 10 for permitting the stone to be laid down into a circle or to produce stones with greater or shorter lengths.

The interlocking means may also be different from the one illustrated in FIG. 2. Moreover, the contour of each of both parts may be different from each other, which produces different widths of the joints. A certain play must be considered in relation with the ribbing 7, or the indentations 12, or other interlocking means in order to compensate for unevennesses of the ground.

Figure 8:
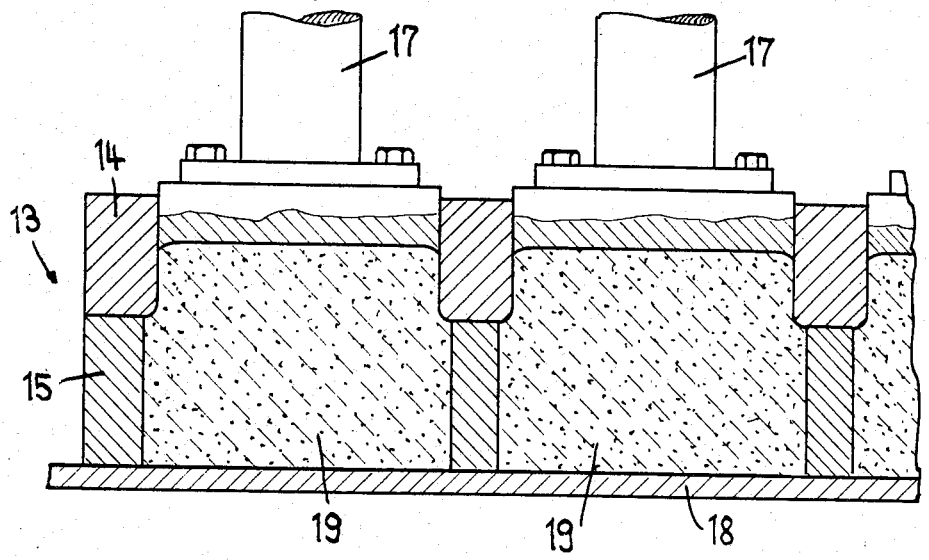
FIG. 8 shows a section of a press used to manufacture paving stones.
Figure 9:
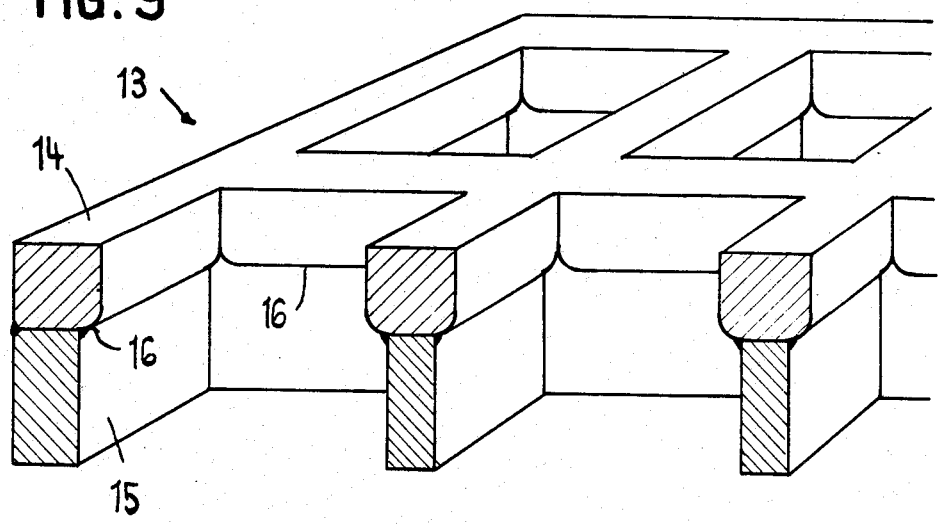
FIG. 9 shows a perspective view of a moulding box constructed according to the present invention.

FIGS. 8 and 9 show respectively a press and a moulding box for the fabrication of the above described paving stones. The moulding box 13 is comprised of two pieces 14 and 15 which are welded or screwed or glued togther or attached by any joining means, whereby the openings of the upper piece 14 have smaller dimensions than the ones of the lower piece 15, the lower piece 15 having a greater height than the one of the upper piece 14. In the present example according to FIG. 9 both pieces are welded together and one recognizes the welded seam at the recess 16. In order to provide the ribbing 7 of the stone 5, a corresponding ribbed metal sheet is inserted into the lower piece 15. It is evident, that any otherwise shaped insert for producing interlocking means may be used also.

As indicated in FIG. 8, it is not necessary to modify the plunger 17 with respect to known plungers because the stone may be easily pressed out of the moulding box. FIG. 8 shows further the movable bottom 18 which is displaced during the pressing out of the preterminated stone 19. The manufacturing process in itself is the same as the process utilized for known stones, whereby the material is fed into the box and subsequently compressed. When the material is consolidated, the preterminated stones are pressed out of the moulding box and carried away with the movable bottom.

It is clear that the moulding box 13 must be adapted to the desired shapes, and that inserts may also be provided in the upper piece 14. For the manufacturing of the paving stones according to the invention, all known materials and known coloring agents may be utilized.

I claim:

1. A paving stone comprising:

a lower portion having at least three vertical faces with each vertical face having a upper edge, and at least one of the faces having a plurality of vertical, regularly-spaced ribs; and an upper portion, integrally connected atop said lower portion; having a plurality of vertical sides equal in number to the vertical faces and respectively integral with and offset inward from the upper edge of a respective one of the vertical faces, the upper portion further having an upper surface, said upper portion having a horizontal cross section of different configuration than a horizontal cross section of said lower portion.

2. The paving stone as recited in claim 1 wherein said upper portion defines randomly dispersed indentations for simulating the appearance of a natural stone.

3. The paving stone recited in claim 1 wherein each of said ribs is symmetric about a vertical line vertically bisecting said each of said ribs.

4. A paving stone having vertical and horizontal coordinate axes comprising:

a lower portion having at least three lateral sides which define a horizontal cross-sectional perimeter, vertical height and a plurality of vertically oriented ribs projecting from at least one of said lateral sides in mutually spaced relationship, so that any one of said ribs interdigitates with any rib of another of said stones when both of said stones are placed in side-by-side, abutting relationship;

an upper portion having a smaller and differently-configured horizontal cross-sectional perimeter and less vertical height than said lower portion; and a recess defined by said paving stone between said upper and lower portions.

5. The paving stone as recited in claim 4 wherein said ribs have a v-shaped horizontal cross-sectional profile.

6. The paving stone as recited in claim 4 wherein said upper portion defines randomly dispersed indentations for simulating the appearance of a natural stone.

7. The paving stone as recited in claim 4 wherein said upper portion defines vertical sides, each side having an arch-shaped horizontal cross-sectional profile.

8. The paving stone as recited in claim 4 wherein said stone defines a notch for facilitation of stone splitting.

9. The paving stone as recited in claim 4 wherein said ribs each define a rib face generally parallel to said lateral side from which said rib projects.

10. The paving stone as recited in claim 4 wherein a horizontal cross section of said lower portion, and of said lower portion absent said plurality of ribs, conforms to a sector of a circle.

11. A paving stone having vertical and horizontal coordinate axes comprising:

a lower portion having at least three lateral sides which define a horizontal cross-sectional perimeter, vertical height, and a plurality of vertically oriented ribs projecting from at least one of said lateral sides in mutually spaced relationship so that any one of said ribs interdigitates with any rib of another of said stones when both of said stones are placed in side-by-side, abutting relationship, for resisting horizontal shearing while allowing for variable offset of abutting stones during placement thereof;

an upper portion having a smaller and differently-configured horizontal cross-sectional perimeter and less vertical height than said lower portion, said upper portion defining randomly dispersed indentations for simulating the appearance of a natural stone; and a recess defined by said paving stone between said upper and lower portions.

* * * * *